US005496105A

United States Patent [19]

Czarnecky et al.

[11] Patent Number: 5,496,105

[45] Date of Patent: Mar. 5, 1996

[54] CABINET HAVING DRAWERS WITH COVER FLANGES

[75] Inventors: Joseph A. Czarnecky; Christopher J. Neff, both of Troy; Scott L. Strait, Greenville, all of Ohio

[73] Assignee: Midmark Corporation, Versailles, Ohio

[21] Appl. No.: 274,792

[22] Filed: Jul. 14, 1994

[51] Int. Cl.[6] ..... A47B 88/16

[52] U.S. Cl. ..... 312/334.4; 312/265.5; 312/330.1; 312/263; 312/334.8; 312/333; 312/265.6

[58] Field of Search ..... 312/334.4, 334.8, 312/334.9, 334.11, 334.12, 330.1, 333, 263, 265.5, 265.6

[56] References Cited

U.S. PATENT DOCUMENTS

| | | | |
|---|---|---|---|
| 3,341,270 | 9/1967 | Sohl | 312/265.5 X |
| 3,716,284 | 2/1973 | Vogt . | |
| 4,173,380 | 11/1979 | Düpree | 312/330.1 |
| 4,440,461 | 4/1984 | Powell et al. | 312/334.8 |
| 4,461,519 | 7/1984 | Hildebrandt | 312/265.6 |
| 4,473,262 | 9/1984 | Staye | 312/330.1 X |
| 4,475,778 | 10/1984 | Stark | 312/333 X |
| 4,662,689 | 5/1987 | Chatterson | 312/333 X |
| 4,681,381 | 7/1987 | Sevey . | |
| 4,685,751 | 8/1987 | Düpree | 312/330.1 X |
| 4,832,422 | 5/1989 | Fortmann | 312/330.1 |
| 4,861,123 | 8/1989 | Russell . | |
| 5,172,971 | 12/1992 | Albiez | 312/330.1 X |
| 5,180,217 | 1/1993 | Lautenschläger | 312/330.1 X |
| 5,235,795 | 8/1993 | DeBusk . | |
| 5,259,668 | 11/1993 | Teufel et al. | 312/263 X |

OTHER PUBLICATIONS

Product Brochure entitled "Waterloo Storage & Delivery Systems," Form No.: HCPC–20–187 (1986).

Product Brochure entitled "Waterloo Storage & Delivery Systems" not dated.

*Primary Examiner*—Jose V. Chen

*Assistant Examiner*—Rodney B. White

*Attorney, Agent, or Firm*—Biebel & French

[57] ABSTRACT

A cabinet is disclosed having a top, base, back and sides, along with an inner panel affixed to an inner surface of each of the cabinet sides. At least one pan is retained within the cabinet, the pan including a front, back, sides, and bottom. A cover flange is associated with each of the pan sides, wherein a channel is formed between each pan side and each cover flange. A slide mechanism is secured within each of the channels so that it is protected by the cover flanges. A support plate is provided with each slide mechanism for mounting to the cabinet inner panels.

18 Claims, 11 Drawing Sheets

CABINET HAVING DRAWERS WITH COVER FLANGES

BACKGROUND OF THE INVENTION

1. Field of the Invention

The present invention relates to a cabinet having drawers with cover flanges, and, more particularly, to a cabinet having drawers with a cover flange associated with each drawer side and a slide mechanism secured within each channel formed between each drawer side and cover flange so that each slide mechanism is protected.

2. Description of Related Art

The versatility of cabinets and the drawers contained therein are viewed with increased scrutiny, and particularly so in the health care field. Due to the specialized nature of medical supplies, pharmaceutical supplies, and equipment, the storage, transportation, and handling of such goods requires increased care. For example, a hospital or laboratory environment requires a clean, and oftentimes sterile, storage area for at least most of the supplies utilized therein. Because a great potential exists for fluid or other contaminants to be present, drawers and their respective slides are exposed thereto. Accordingly, one problem that exists is that the drawer and its respective slides require periodic cleaning and/or sterilization. Noteover, the ability of a drawer to slide within a cabinet in such an environment may become impaired.

Further, because the health care field now tends to prepackage certain medical supplies for a particular procedure, it has become preferable for a drawer or tray containing such medical supplies to be easily transportable and reusable. This is consistent with the current practice for medical suppliers to maintain various "procedural trays" in the supplier's warehouse and then deliver to the medical facility those trays that are ordered on relatively short notice. Thus, the ease of insertion and removal of such drawers from cabinets for cleaning or replacement with a new procedural tray is of paramount importance. Likewise, it would be very desirable for such drawers or trays to be interchangeable with cabinets at various locations within the facility. Such a system would allow rearrangement of cabinets with drawers of different sizes for the specific needs at a particular location without having to remove countertops and other structures fixed adjacent to such cabinets.

In addition, because there are several cabinet designs, including those having drawers with front panels and those having drawers enclosed by front closing doors, it would be a desirable feature for the drawers and slides thereof to be reversible. This would not only assist the interchangeability of such drawers and slides within a given facility, but also enable them to be slid in and out of pass-through cabinets or carts.

SUMMARY OF THE INVENTION

The cabinet of the present invention includes one or more drawers, also known as "pans," which include a pair of cover flanges associated with each side thereof, The cover flanges cooperate with sides of the pan to form channels which protect the slide mechanisms secured within. The pans and slide mechanisms can also be easily inserted and removed for cleaning and the like, and have the ability to be reversed with respect to the cabinet in order to promote versatility.

In accordance with one aspect of the present invention, a cabinet is disclosed having a top, base, back and sides, along with an inner panel affixed to an inner surface of each of the cabinet sides. At least one pan is retained within the cabinet, the pan including a front, back, sides, and bottom. A cover flange is associated with each of the pan sides, wherein a channel is formed between each pan side and each cover flange. A slide mechanism is secured within each of the channels so that it is protected by the cover flanges, A support plate is provided with each slide mechanism for mounting to the cabinet inner panels.

Accordingly, a primary objective of the present invention is to provide a cabinet having one or more pans which provide protection to its respective slide mechanisms against contaminants and the like.

Another objective of the present invention is to provide a cabinet having pans which can be easily inserted and removed for cleaning and sterilization.

Yet another objective of the present invention is to provide a cabinet having one or more pans which are interchangeable with other cabinets of like construction.

Another objective of the present invention is to provide a drawer-type cabinet having one or more slide-mounted pans which may be reversed for a given cabinet style.

These objectives and other features of the present invention will become more readily apparent upon reference to the following description when taken in conjunction with the following drawing.

BRIEF DESCRIPTION OF THE DRAWING

While the specification concludes with claims particularly pointing out and distinctly claiming the present invention, it is believed that the same will be better understood from the following description taken in conjunction with the accompanying drawing in which:

DETAILED DESCRIPTION OF THE INVENTION

Figure 2:
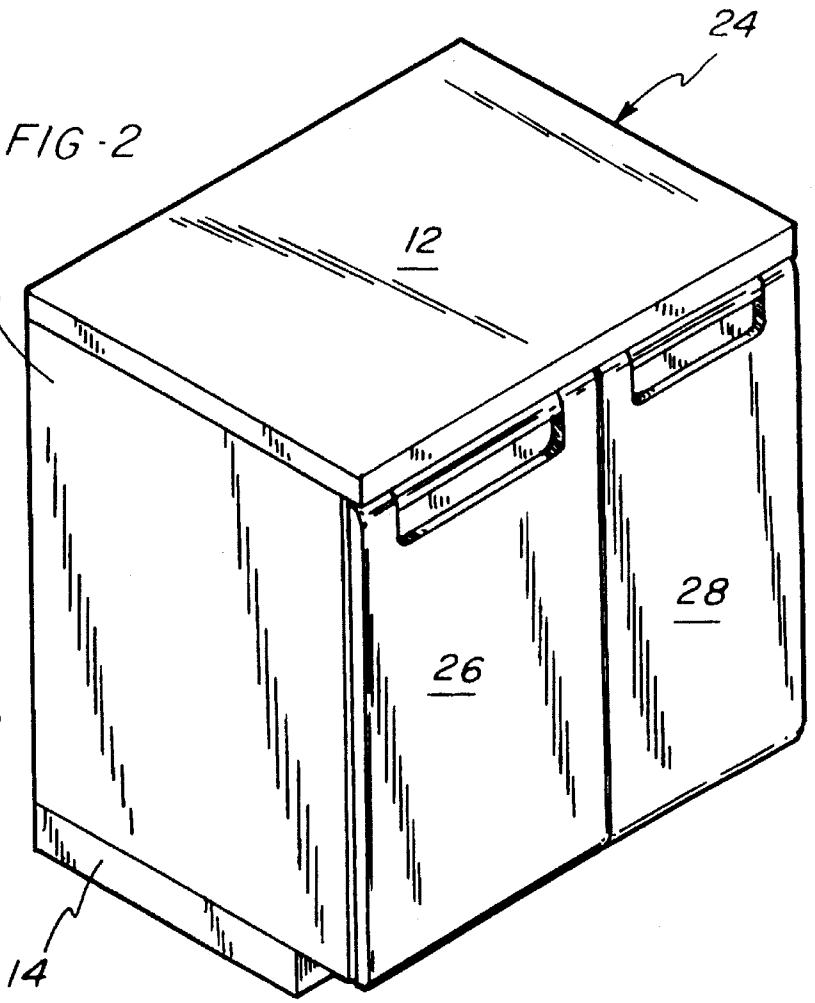
FIG. 2 is a perspective view of a drawer-type cabinet of the present invention in which the cabinet front is closed by a pair of doors.
Figure 1:
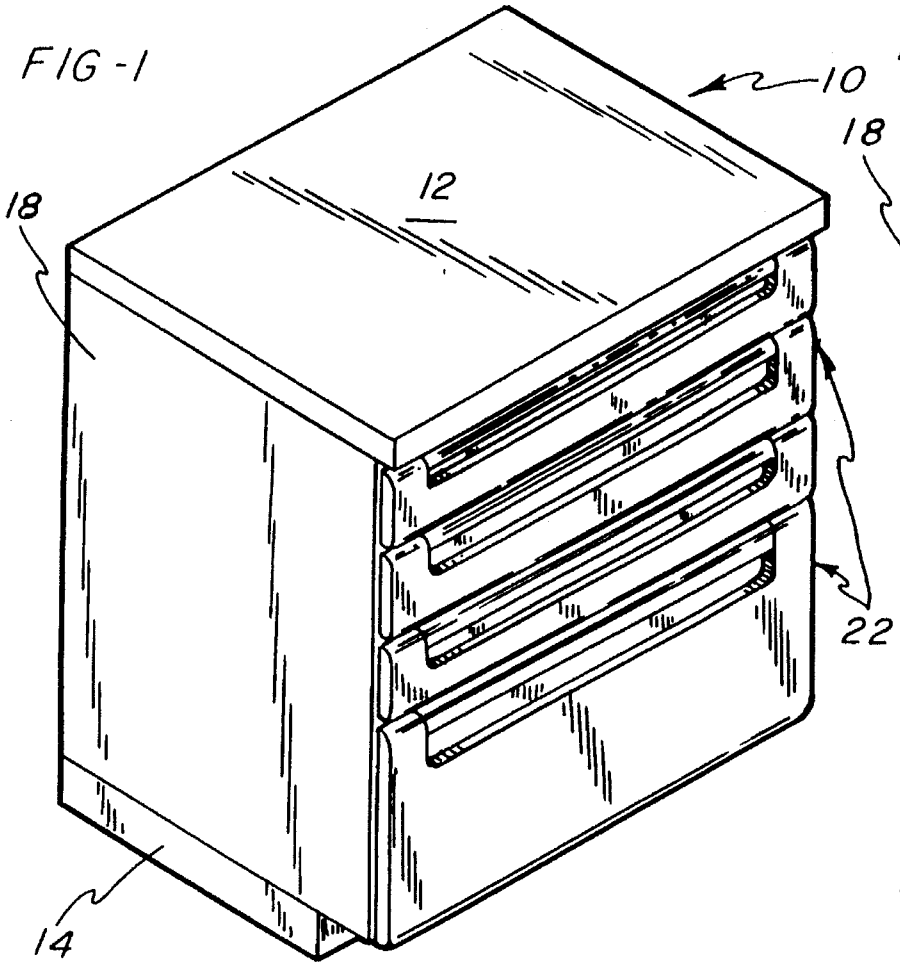
FIG. 1 is a perspective view of a drawer-type cabinet of the present invention in which the drawers are provided with front-panels.
Figure 3:
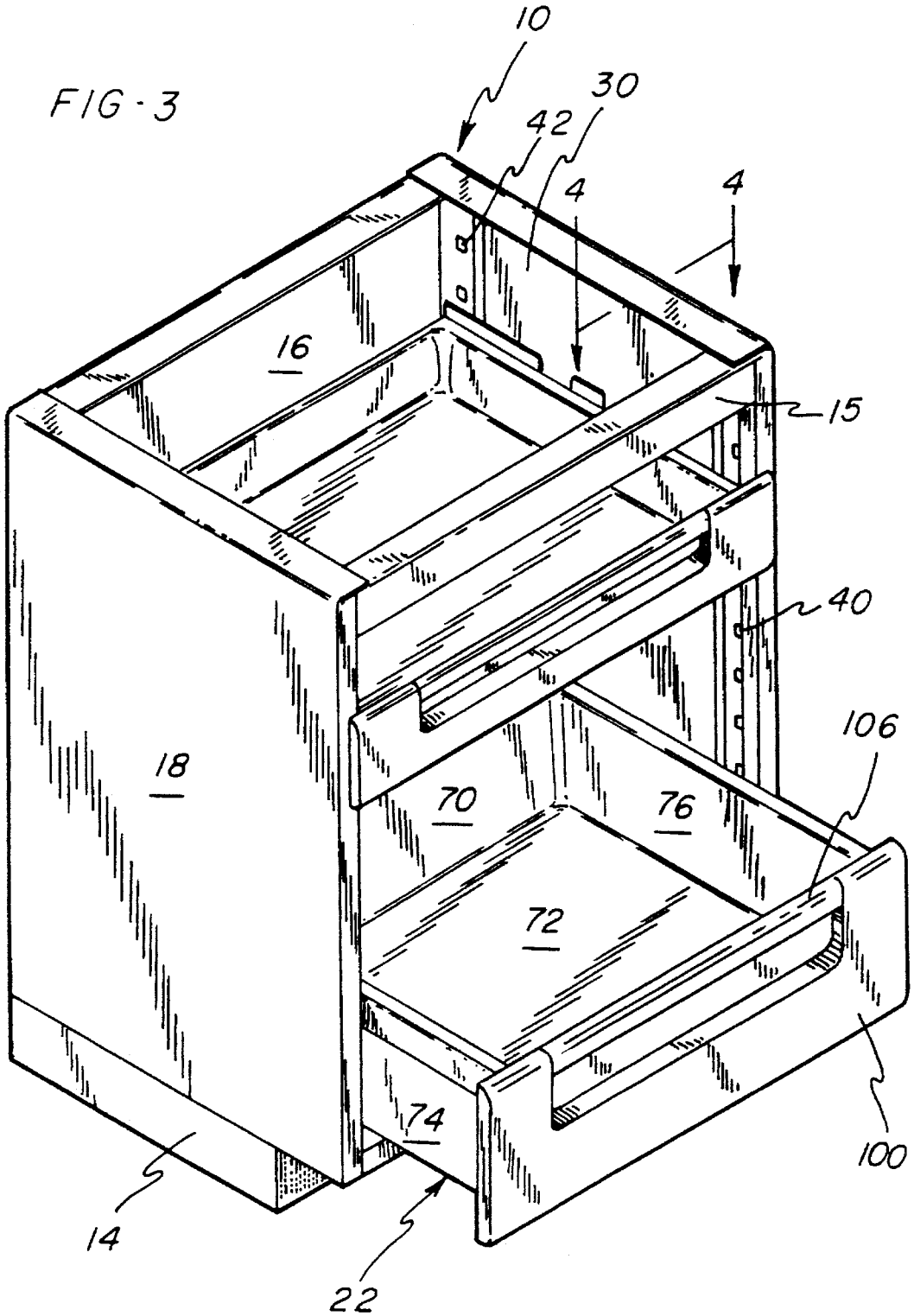
FIG. 3 is a perspective view of the cabinet of FIG. 1, where the top and middle drawers have been omitted for clarity.

Referring now to the drawings in detail, wherein identical numerals indicate the same elements throughout the figures, FIG. 1 depicts a preferred embodiment of a cabinet 10 having a top 12, a base 14, a back 16, and sides 18 and 20 (see FIGS. 1 and 3). A front brace 15 is also provided between the upper ends of sides 18 and 20. It will also be seen from FIG. 1 that cabinet 10 includes a plurality of drawers or trays, also known in the industry as pans, which may be of varying depths retained therein. A cabinet 24 of an alternate design is depicted in FIG. 2, where a pair of front doors 26 and 28 may be utilized to fully enclose the pans 22 retained therein. The installation of pans 22 in cabinet 24 will be discussed herein; otherwise, the basic construction of cabinet 24 is the same as that of cabinet 10.

Figure 4:
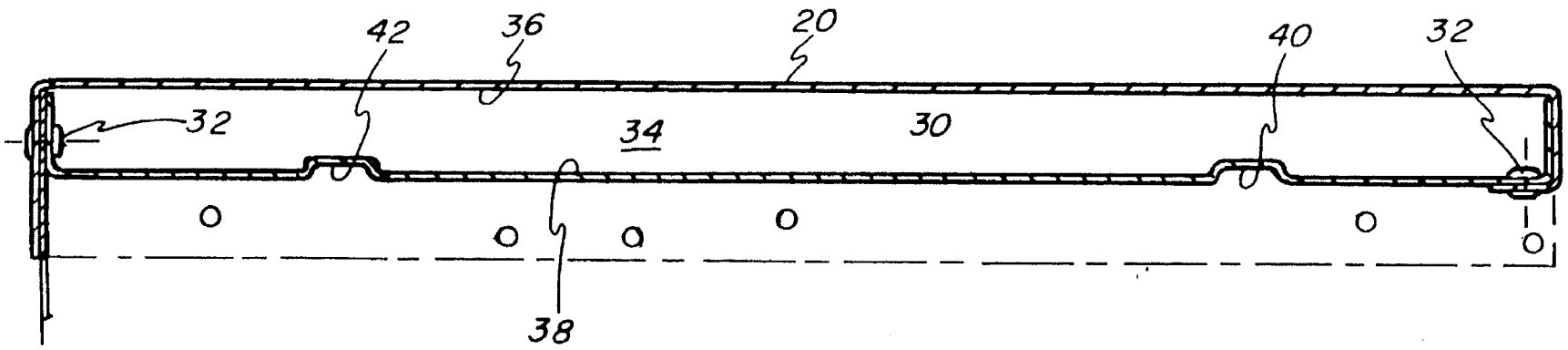
FIG. 4 is a partial sectional view of the cabinet taken along line 4—4 of FIG. 3, where an air space between the cabinet side and an inner panel is depicted.
Figure 5:
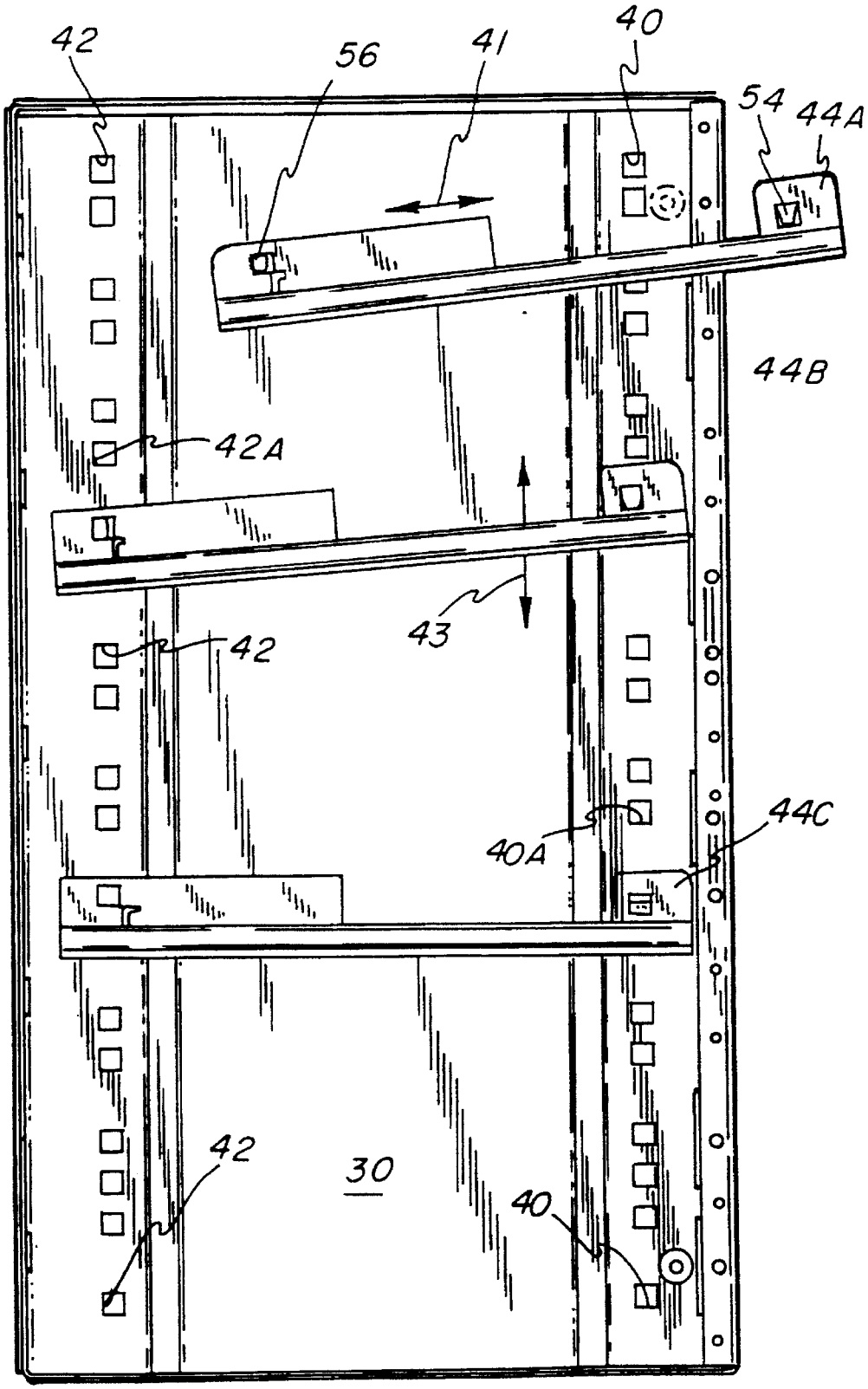
FIG. 5 is an inside elevational view of FIG. 3, where the process of inserting/removing the slide mechanism is depicted.

As shown in FIGS. 3–5, a pair of inner panels 30 are affixed to the inner surfaces of cabinet sides 18 and 20 (only one of which is shown). Inner panel 30, which is shown as being connected to cabinet side 20 by means of pop rivots 32, creates a space 34 between an inner surface 36 of cabinet side 20 and an outer surface 38 of inner panel 30 (see FIG. 4). Further, inner panels 30 include a front series of vertical slots 40 and a rear series of vertical slots 42, which preferably are rectangular in shape. Additionally, it will be seen from FIG. 5 that for each front slot 40 there is a rear slot 42 which is in substantial horizontal alignment therewith.

Figure 10:
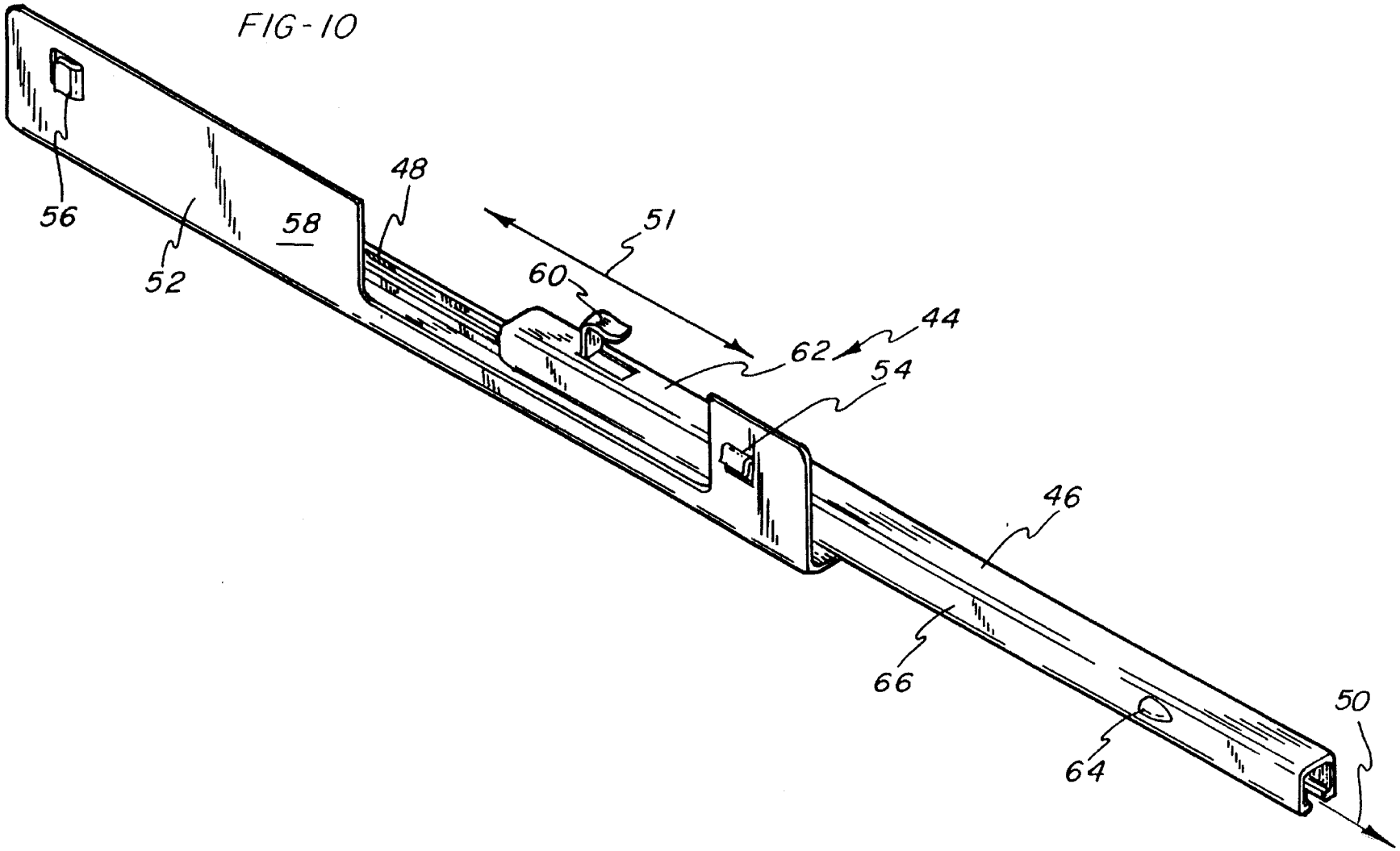
FIG. 10 is a perspective view of the slide mechanism shown in FIG. 5.

Pans 22 are slidingly retained within cabinet 10 by means of a pair of glide or slide mechanisms 44, one of which being shown in detail in FIG. 10. Slide mechanisms 44 include a channel 46 and a rail 48, wherein channel 46 is slidable on rail 48 in a direction along longitudinal axis 50 as is shown by arrow 51. The basic channel/rail construction is well known and may be obtained commercially from Herrich America L.P. located in Harrisonville, Miss. The slide mechanism 44 of the present invention has been modified so as to include a support plate 52 (through the use of bayonet clips) for mounting slide mechanism 44 to inner panels 30 of cabinet 10. In particular, support plate 52 is fixedly connected to the bottom of rail 48 (not shown), such as by welding or other means, so that it has an L-shaped design. As best seen in FIG. 10, support plate 52 includes a front bayonet 54 and a rear bayonet 56 formed within a vertical portion 58 thereof. It will be seen that front and rear bayonets 54 and 56 are in substantial horizontal alignment, with front bayonet 54 being oriented in a downward direction and rear bayonet 56 is oriented in a rearward direction. Consequently, front and rear bayonets 54 and 56 are oriented approximately 90° to each other.

As seen in FIG. 5, the insertion of slide mechanism 44 onto an inner panel 30 involves a two-step process. First, slide mechanism 44 is positioned so that rear bayonet 56 is able to engage a rear slot 42, which involves a substantially horizontal movement. For ease of accessibility, however, elide mechanism 44A may be oriented at a slight angle to such a horizontal plane and moved in the direction of arrow 41. Once slide mechanism 44 has been positioned so that rear bayonet 56 engages a rear slot 42 along a rear vertical edge 42A, the engagement of front bayonet 54 with a front slot 40 (in horizontal alignment with rear slot 42) occurs by a substantially vertical downward movement as shown by arrow 43 with respect to elide mechanism 44B. Accordingly, slide mechanism 44 is then retained to inner panel 30, as shown by slide mechanism 44C, once front bayonet 54 engages a lower horizontal edge 40A of slot 40. It will be understood that removal of slide mechanism 44 from inner panel 30 is accomplished by first disengaging front bayonet 54 from slot 40 and then disengaging rear bayonet 56 from slot 42 in reverse of the insertion process described above.

It will be noted in FIG. 10 that slide mechanism 44 includes a latching member 60 formed at the rearward end of a top portion 62 of channel 46. A detent 64 is also formed at the forward end of side surface 66 of channel 46. Accordingly, it will be seen that latching member 60 and detent 64 are oriented in planes approximately 90° to each other. Latching member 60 and detent 64 are utilized to engage pan 22 to slide mechanism 44 as described hereinafter.

Figure 6:
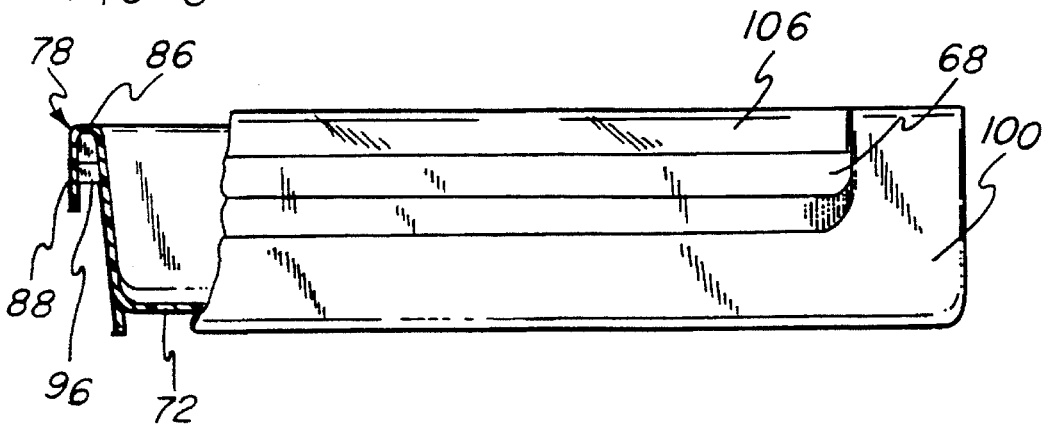
FIG. 6 is a front view of a pan shown in FIGS. 1 and 3, which is partially broken away to show a side channel.
Figure 7:
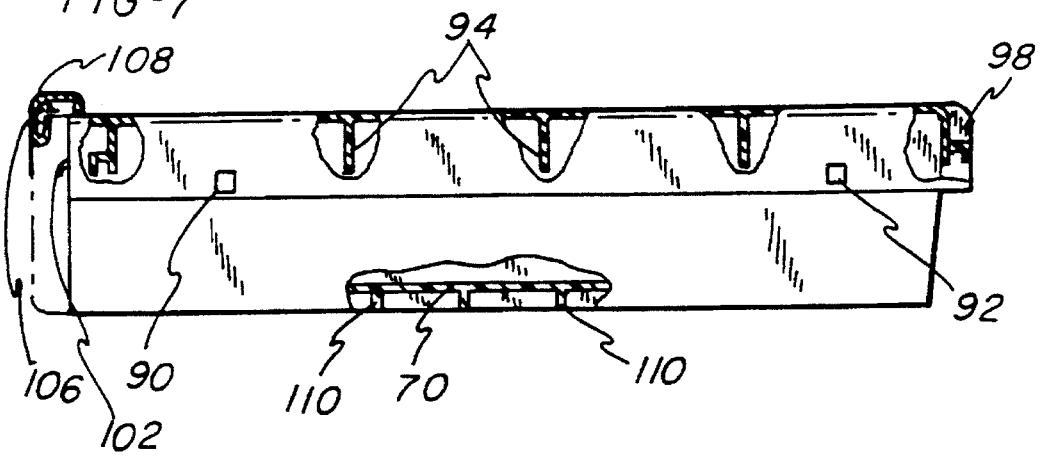
FIG. 7 is a side view of the pan of FIG. 6, which is partially broken away to show the positioning supports and retaining ledges in the side channel, as well as the bottom supports.
Figure 8:
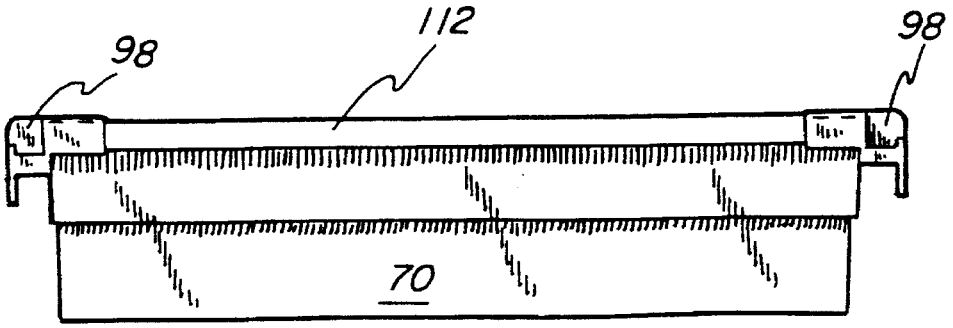
FIG. 8 is a rear view of the pan of FIG. 6.
Figure 9:
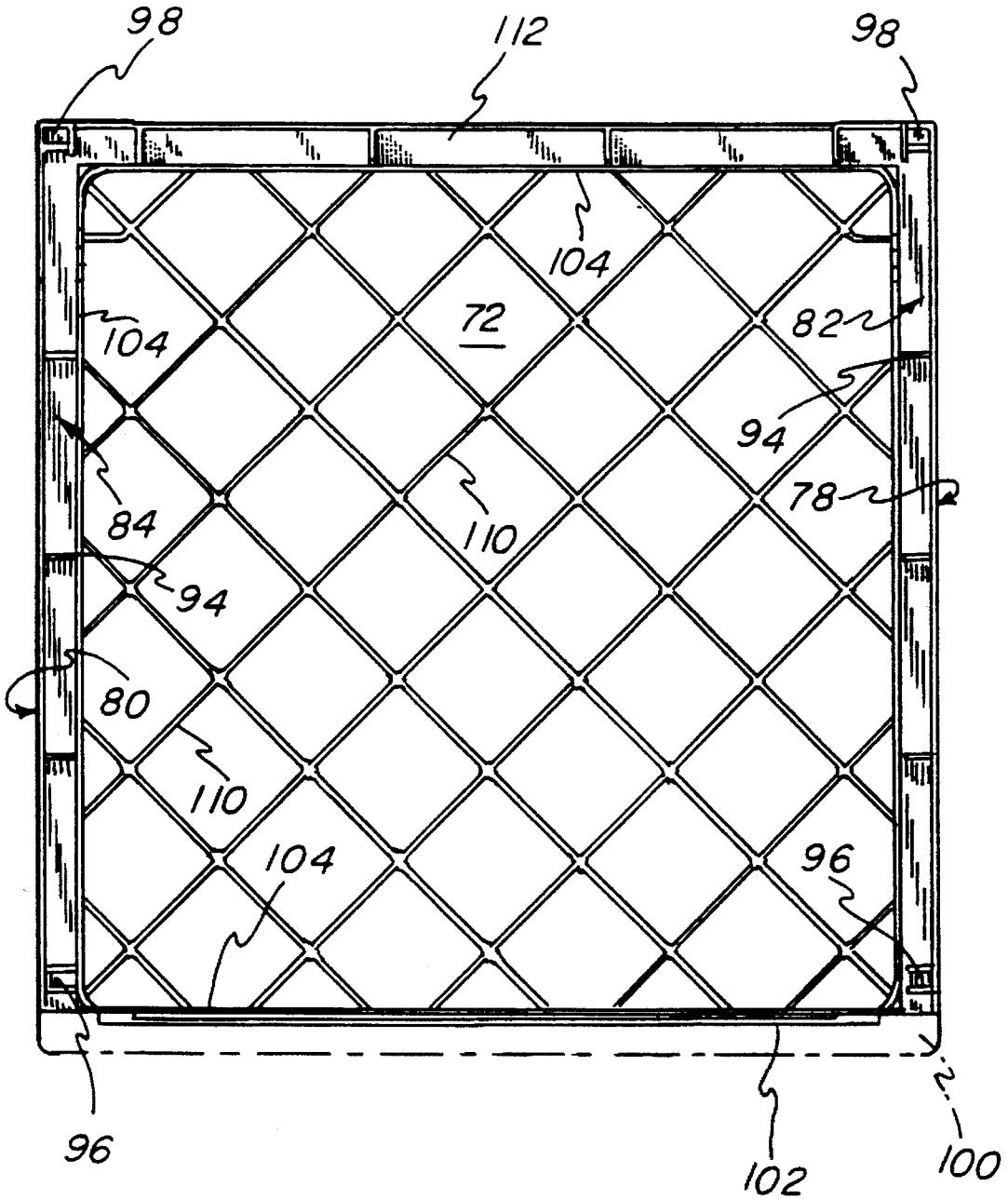
FIG. 9 is a broken view of the pan of FIG. 6.

Pan 22 includes a front 68, back 70, bottom 72, and sides 74 and 76 so as to form a storage area as is commonly known. Pan 22 also includes a pair of cover flanges 78 and 80 which preferably are integral with pan sides 74 and 76, respectively, so as to form a pair of channels 82 and 84 therebetween (as seen in FIG. 9). As best seen in FIG. 6, cover flanges 82 and 84 each include a horizontal portion 86 and a vertical portion 88, where a front opening 90 and a rear opening 92 are formed within vertical section 88. It will be understood that cover flanges 78 and 80 are mirror images of each other, so description with respect to cover flange 80 is also applicable to cover flange 78. It will be seen from FIGS. 7 and 9 that a plurality of supports 94 extend downward from horizontal section 86 of cover flanges 78 and 80 within channels 82 and 84 so that when slide mechanisms 44 are retained therein it is done so at the proper position. Front and rear step members 96 and 98, as shown in FIGS. 6, 8 and 9, are also associated with cover flanges 78 and 80. It will be understood that rear step member 98 is formed along the junction of pan back 70 and pan sides 74 and 76. Of course, a corresponding rear step member 98 is provided at the junction of pan back 70 and pan side 74.

Figure 11:
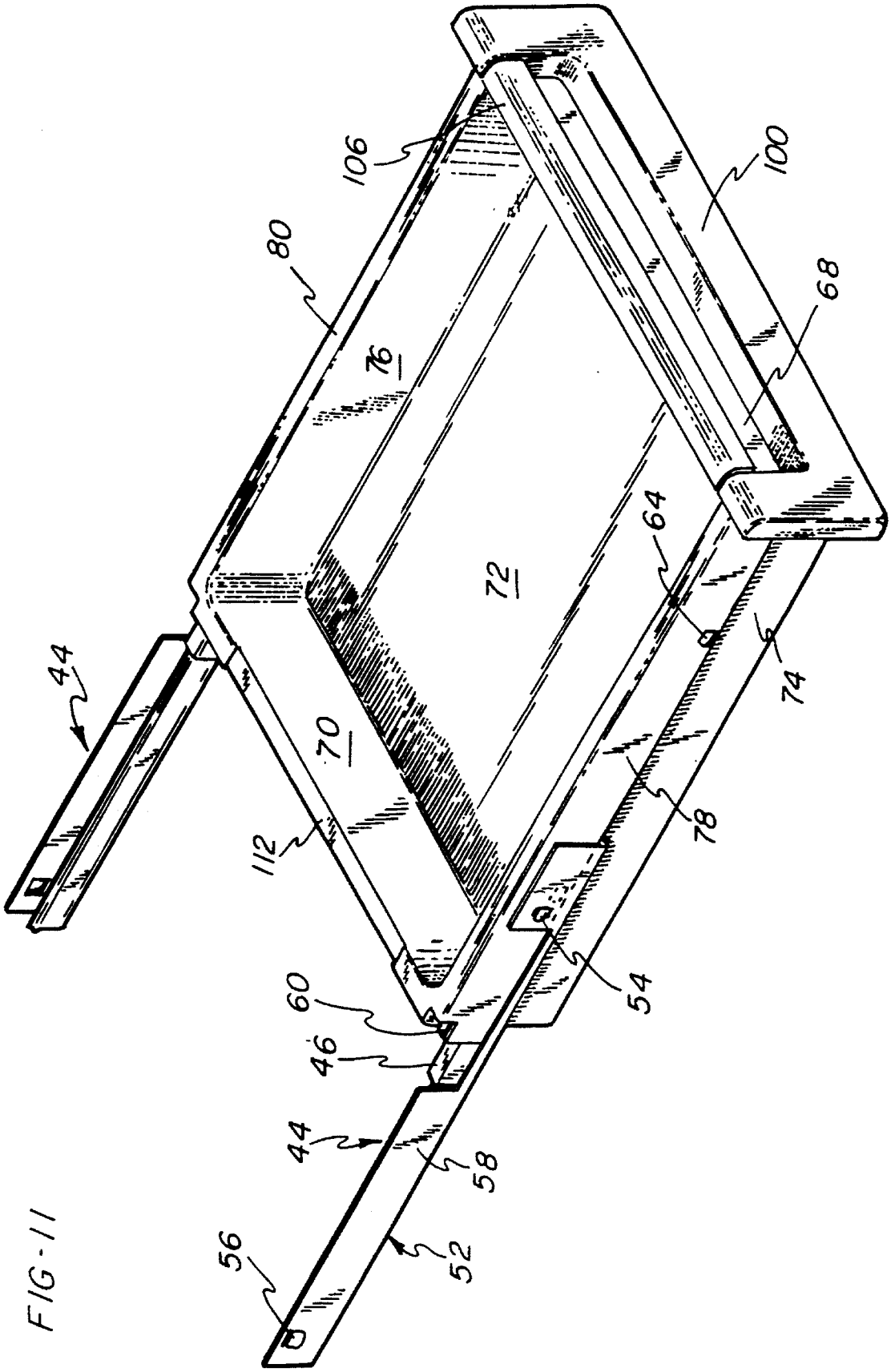
FIG. 11 is a perspective view of the pan and slide mechanism shown in FIG. 3 while in the extended position.
Figure 13:
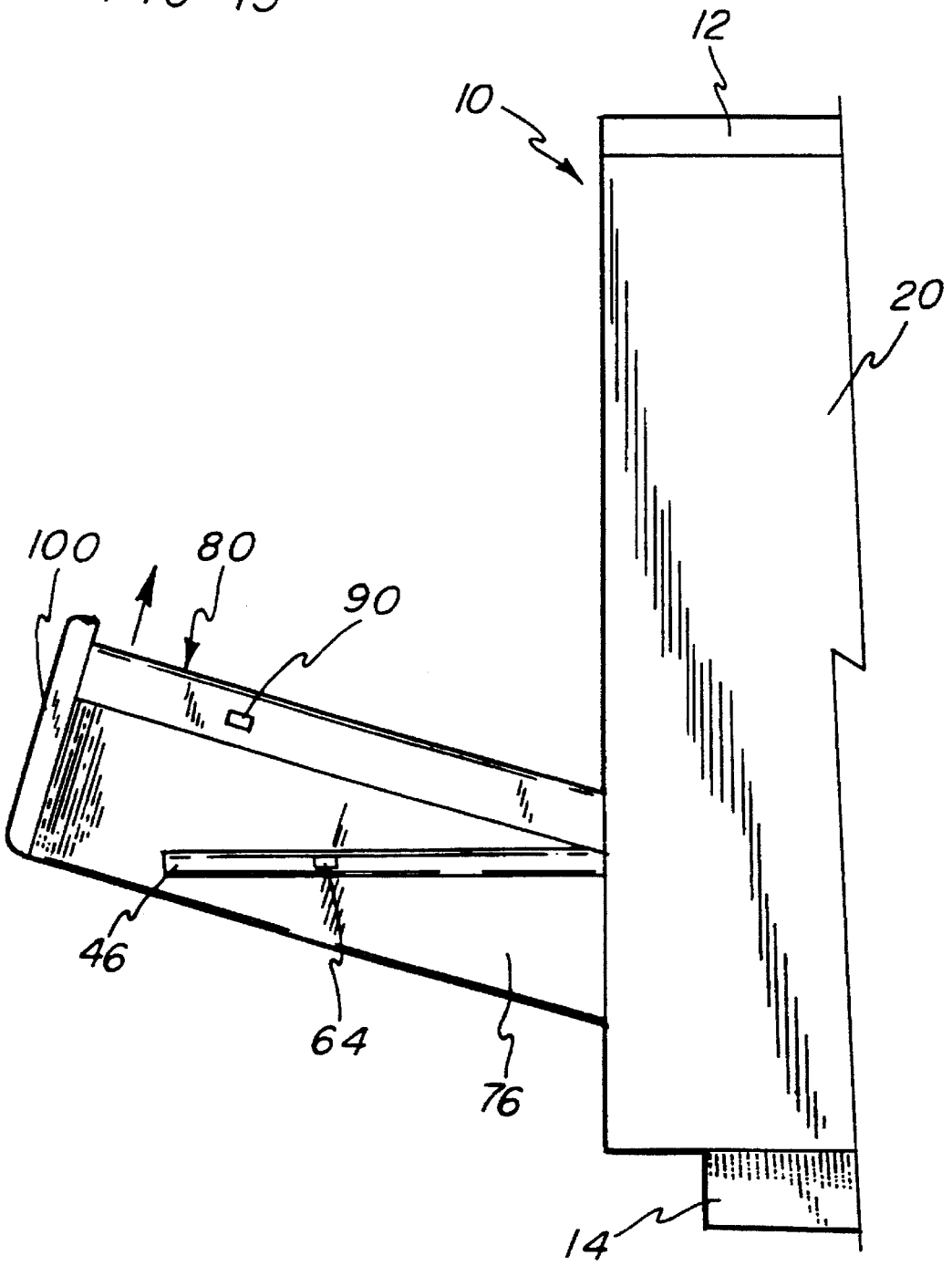
FIG. 13 is a partial side view of a pan being removed from the slide mechanism where the slide mechanism is connected within the cabinet of FIG. 1.

As seen in FIG. 11, the channels 46 and rails 48 of slide mechanisms 44 are nested within channels 82 and 84. It will be understood that slide mechanisms 44 are retained to pan 22 on each side thereof by means of detent 64 and latching member 60. Latching member 60 is first affixed to rear step member 98 and then locked into place by snapping detent 64 into front opening 90. Correspondingly, pan 22 is disengaged from slide mechanism 44 by exerting an outward pressure on vertical section 88 of cover flanges 78 and 80 so that detent 64 is allowed to slip out front opening 90. Latch member 60 of slide mechanism 44 may then be disengaged from rear step member 98 by lifting pan 22 at an angle (as seen in FIG. 13) and then pulling outward. Because latch member 60 and detent 64 are located in orthogonal planes, pans 22 cannot accidentally disengage from slide mechanisms 44 from motion in only a single plane.

Figure 14:
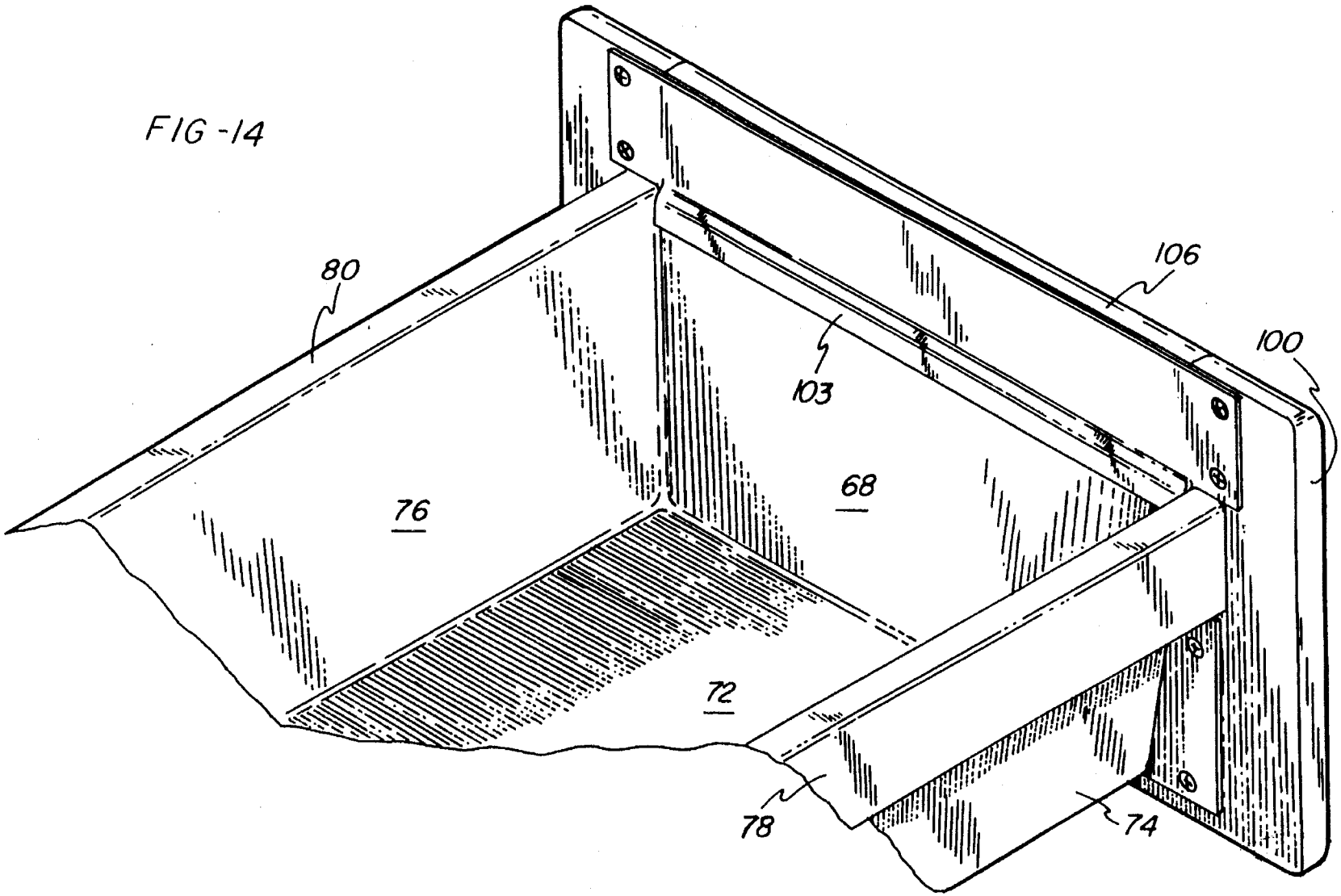
FIG. 14 is a partial perspective view of the interior of the pan depicted in FIGS. 6–9 with the front panel attached.

It will be seen from FIGS. 1, 3, 6, and 11 that pan 22 of cabinet 10 will preferably include a front panel 100. In order to position front panel 100 correctly onto pan front 68, a flange 102 (as best seen in FIG. 7) is incorporated transversely across pan front 68. Accordingly, a groove may be formed within front panel 100 (not shown) for abutment with flange 102, front panel 100 then being attached to pan 22 by screws or other means at the front portion of an extension 104 that is present about the bottom periphery of pan 22. In order to prevent liquid or contaminants from escaping the storage area of pan 22 out of a junction between pan front 68 and front panel 100, a lip 103 preferably is provided on a rearward side 101 of front panel 100 (see FIG. 14).

Pan 22 further includes a pull 106 formed from the top surface of pan front 68 so pan 22 may be easily grasped. A plastic casing 108 is preferably utilized with front pull 106 so that identifying material or labels may be captured therebetween.

As seen from FIG. 9, not only does a bottom extension 104 encircle pan bottom 72 but a grid 110 is also provided for structural support of pan 22. Grid 110 is shown as a criss-cross design, but may be of any design which provides support.

Figure 12:
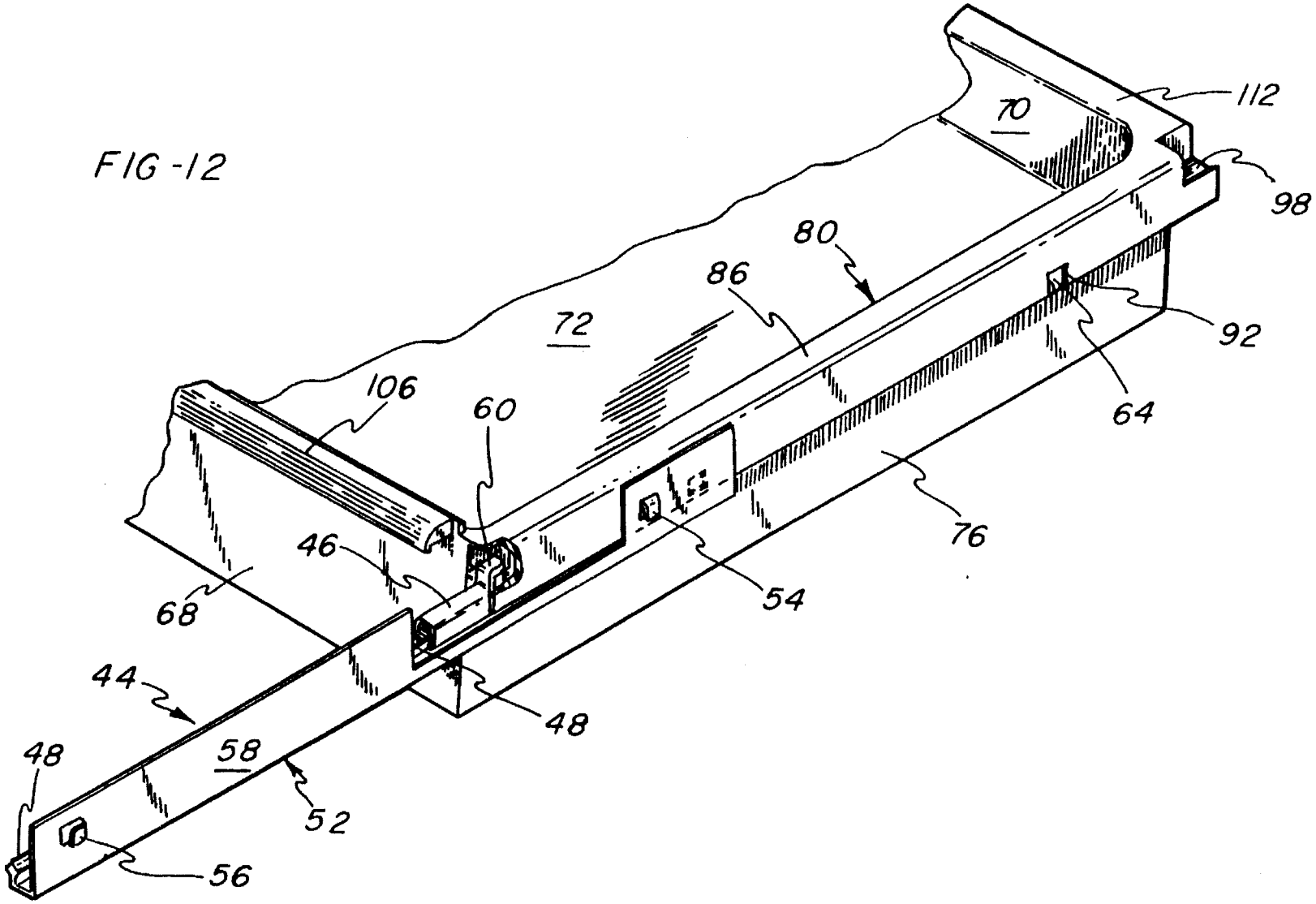
FIG. 12 is a partial perspective view of the pan and slide mechanism shown in FIG. 3 where the front panel has been removed and the pan has been reversed with respect to the slide mechanisms.

As noted above, one object of the present invention is to provide a pan which may be reversed with respect to slide mechanisms 44. FIG. 12 depicts pan 22 in such a reversed position with a slide mechanism 44. In this orientation, latching member 60 of slide mechanism 44 is caused to engage front step member 96 and detent 64 then engages rear opening 92. It will be noted that front step member 96 is located within channel 82 and thus is slightly rearward of the intersection of pan sides 74 and 76 and pan front 68. By creating a slight asymmetrical relationship between front step member 96 and rear step member 98, pan 22 is allowed to slide slightly further into cabinet 10. Of course, it will be understood that before pan 22 takes such a reversed position, front panel 100 must be removed. Since pan 22 can now be positioned completely within a cabinet, such as that shown by cabinet 12 in FIG. 2, front doors 26 and 28 may be included to completely enclose pan 22. It should also be understood, although not shown, that due to the reversible feature of pan 22 with sliding mechanisms 44, such pans may be utilized with a pass-through cabinet or medical cart whereby pans 22 may slide out from either of the opposite ends depending upon the needs of the user. Thus, a rear pull 112 is also provided so that pan 22 may be easily gripped when in the reversed orientation (see FIGS. 8, 9, 11 and 12). As with front pull 106, a plastic overlay may be utilized with rear pull 112 to contain identifying labels or other indicia.

It will be understood that pan 22 and associated cover flanges 78 and 80 are of a one-piece construction. This is accomplished by means of injection molding or any other process capable of performing such a one-piece construction.

Having shown and described the preferred embodiment of the present invention, further adaptations of the cabinet, the pans, and the slide mechanisms can be accomplished by appropriate modifications by one of ordinary skill in the art without departing from the scope of the invention.

What is claimed is:

1. A cabinet comprising:

(a) a top, base, back and sides;

(b) an inner panel affixed to an inner surface of each of said cabinet sides, each said inner panel further comprising at least one pair of aligned front and rear slots;

(c) at least one drawer, further comprising:

(1) a front, back, sides, and bottom; and (2) a cover flange located adjacent each of said drawer sides, wherein a channel is formed between each drawer side and each cover flange; and (d) a slide mechanism secured within each of said channels, wherein said slide mechanisms are protected by said cover flanges, each of said slide mechanisms including a support plate having a pair of aligned front and rear bayonets incorporated thereon for mounting said slide mechanism to each of said cabinet inner panels by insertion of said bayonets into said slots.

2. The cabinet of claim 1, wherein said bayonets are oriented approximately 90° to each other.

3. The cabinet of claim 2, wherein said front bayonet of each slide mechanism is oriented toward said cabinet base.

4. The cabinet of claim 2, wherein said back bayonet of each slide mechanism is oriented toward said cabinet back.

5. The cabinet of claim 2, wherein each of said slide mechanisms are mounted to said inner panels by inserting said rear bayonets horizontally into said rear slots and said front bayonets vertically into said front slots.

6. The cabinet of claim 5, further comprising:

(a) at least one opening in each of said cover flanges;

(b) at least one retaining ledge associated with each of said cover flanges;

(c) a detent in each of said slide mechanisms which engages said cover flange opening; and (d) a latch on each of said slide mechanisms which engages said cover flange retaining ledge;

wherein each of said slide mechanisms are secured within said drawer channels by engaging said latches on said retaining ledges and said detents in said cover flange openings, said detents being engaged to said cover flange openings in a substantially 90° orientation to said front bayonet engagement with said front inner panel slot and said latches being engaged to said rear ledges in a substantially 90° orientation to said rear bayonet engagement with said rear inner panel slot.

7. The cabinet of claim 1, wherein each of said inner panels has a plurality of vertically aligned front and rear slots.

8. The cabinet of claim 1, said cabinet being incorporated into a medical cart.

9. A cabinet, comprising:

(a) a top, base, back and sides;

(b) an inner panel affixed to an inner surface of each of said cabinet sides;

(c) at least one drawer, further comprising:

(1) a front, back, sides and bottom;

(2) a cover flange located adjacent each of said drawer sides, wherein a channel is formed between each drawer side and each cover flange, each said cover flange having at least one opening formed therein; and (3) at least one retaining ledge associated with each of said cover flanges; and (d) a slide mechanism secured within each of said channels, wherein said slide mechanisms are protected by said cover flanges, each of said slide mechanisms further comprising:

(1) a detent which engages said cover flange opening; and (2) a latch which engages said cover flange retaining ledge.

10. The cabinet of claim 9, further comprising a plurality of supports spanning each of said channels between said drawer side and cover flange.

11. The cabinet of claim 3, wherein each of said drawers and adjacent cover flanges are of a one-piece construction.

12. The cabinet of claim 11, wherein said drawer and cover flanges are injection molded.

13. The cabinet of claim 9, said drawer front Including a flange on an outer surface thereof adapted for retaining a front panel thereto, said front panel extending transversely across and to the side of said drawer front so as to abut a front surface If said cabinet sides.

14. The cabinet of claim 9, said drawer including a pull incorporated on said drawer front.

15. The cabinet of claim 9, said drawer including a retaining ledge within each of said channels and a second opening in each of said cover flanges, wherein said slide mechanisms are reversibly securable within said channels.

16. A drawer and interlocking slide mechanism for a cabinet, comprising in combination:

(a) a drawer having a front, back, sides and bottom, said drawer including a cover flange located adjacent each of said drawer sides, wherein a channel is formed between each drawer side and each cover flange, each said cover flange further comprising:

(1) at least one opening formed therein; and (2) at least one retaining ledge associated therewith; and (b) a slide mechanism secured within each of said channels, wherein said slide mechanisms are protected by said cover flanges, each of said slide mechanisms further comprising:

(1) a support plate for mounting said slide mechanism to said cabinet;

(2) a detent which engages said cover flange opening; and (3) a latch which engages said cover flange retaining ledge.

17. The drawer and interlocking slide mechanism of claim 16, said drawer including a retaining ledge within each of said channels and a second opening in each of said cover flanges wherein said slide mechanisms are reversibly securable within said channels.

18. The drawer and interlocking slide mechanism of claim 16, wherein said retaining ledges are located at back corners of said drawer defined by an intersection of said drawer back and each of said drawer sides.

* * * * *